United States Patent [19]

Whitsitt

[11] Patent Number: 4,756,525

[45] Date of Patent: Jul. 12, 1988

[54] TAPERED ELONGATED WEIGHT WRAP

[76] Inventor: Luther Whitsitt, 2050 Elberon St., Rancho Palos Verdes, Calif. 90732

[21] Appl. No.: 825,987

[22] Filed: Feb. 4, 1986

[51] Int. Cl.[4] ..... A63B 23/04

[52] U.S. Cl. ..... 272/119

[58] Field of Search ..... 272/119; 128/165

[56] References Cited

U.S. PATENT DOCUMENTS

| | | | |
|---|---|---|---|
| 1,074,939 | 10/1913 | Fredrikson | 27/119 |
| 3,490,766 | 1/1970 | Gardner | 272/119 |
| 3,528,652 | 9/1970 | Tarbox | 272/119 |
| 3,532,339 | 8/1968 | Smith | 272/119 |
| 3,719,299 | 1/1973 | Duncan | 272/119 X |
| 3,942,525 | 3/1976 | Dragan | 128/165 |
| 4,192,502 | 3/1980 | Owen | 272/119 |
| 4,322,072 | 3/1982 | White | 272/119 |
| 4,586,506 | 5/1986 | Nangle | 272/119 |

FOREIGN PATENT DOCUMENTS

| | | | |
|---|---|---|---|
| 188798 | 4/1937 | Switzerland | 128/165 |
| 6283 | of 1910 | United Kingdom | 128/165 |

*Primary Examiner*—Richard J. Apley
*Assistant Examiner*—David Bender
*Attorney, Agent, or Firm*—Noel F. Heal

[57] ABSTRACT

A training weight and a related method for applying it to a limb, to provide good weight distribution and to anchor it securely. The training weight includes a weighted enclosure with two opposing convex sides whose greatest width is at their center, a resilient band attached to one end of the enclosure, a Velcro strip attached to the opposite end, and a complementary strip attached to the face of the enclosure. The resilient band is wrapped around the limb to anchor the training weight, then the enclosure is spirally wrapped around the limb, and the weight is secured by the Velcro fastener.

1 Claim, 2 Drawing Sheets

TAPERED ELONGATED WEIGHT WRAP

BACKGROUND OF THE INVENTION

This invention relates generally to the field of training weights, and, more particularly, to training weights used to strengthen the limbs and worn on the wrist or ankle when training for a sports activity, or during physical therapy.

A training weight of this type consists of a weighted, generally flat, but flexible enclosure, typically of a plastic or fabric material, with an attached strap and, typically, a Velcro or similar type of fastener for securing the weight to the limb. The training weight, when worn during prescribed exercises or while participating in a sports activity, strengthens limb muscles and may be useful therapy following surgery or injury to the limb.

More specifically, the weighted enclosure of a training weight of this type is generally rectangular in shape, with compartmented sections filled with heavy material, such as lead, to distribute the weight evenly over the length of the enclosure. The training weight enclosure is wrapped around the limb at the wrist or ankle, and secured with the Velcro or similar fastener. In the case of Velcro, a Velcro strip is attached to one face of the enclosure, facing out from the limb. The complementary strip of the fastener is attached to the end of the enclosure that is wrapped last. The complementary strip is then wrapped over the top of the enclosure and in contact with the Velcro strip attached to the enclosure. Other fastening means may also be used, such as buckles or ties.

Training weights available prior to the present invention suffer from the disadvantage that they concentrate weight at the point on the limb to which the weights are secured. This is often disconcerting to the wearer of the weights, since the limbs often have an "unnatural" feeling when additional weight is concentrated at the wrists or ankles. This is particularly true if the weights are to be worn during sports activities or games. A related difficulty is that weights secured to the wrists or ankles almost always loosen and move during training or other activity, further contributing to the unnatural feeling associated with wearing the weights. Movement of the training weights can also cause chafing and abrasion of the skin, as well as possible aggravation of an injury if used during physical therapy.

It will be appreciated from the foregoing that there has long been a need for improvement in the field of training weights. In particular, there has been a need for a training weight that is attachable more securely to the limb, preferably in such a manner that the weight is more evenly distributed. The present invention satisfies this need.

SUMMARY OF THE INVENTION

The present invention resides in a training weight with a novel combination of fastening means that both holds the weight more securely on the limb and distributes the weight over a larger extent of the limb. Briefly, and in general terms, the invention includes a weighted, generally flat, and flexible enclosure, anchoring means for securing one end of the enclosure to a limb, means integral with the enclosure to facilitate wrapping the weight in a distributed manner, and fastening means to secure the wrapped weight to the limb. In the illustrative embodiment of the invention, the means to facilitate wrapping in a distributed manner includes a tapered portion of the enclosure.

More specifically, the weighted enclosure is generally rectangular in shape, and is sectioned or compartmented to ensure uniform weight distribution. The enclosure has its greatest width near the center of its longest sides and is tapered along both these sides towards the ends of the enclosure. This tapering facilitates the wrapping in a helical or spiral configuration along the limb. The anchoring means in the preferred embodiment of the invention includes a resilient band attached to one end of the enclosure and of sufficient length to wrap around a limb usually at the ankle or wrist. The fastening means, for releasably securing the weighted enclosure to the limb, has at least one component attached to the opposite end of the enclosure.

The anchoring means is wrapped around the limb at the desired point of application of the weighted enclosure. The weighted enclosure is then lap wrapped or spirally wrapped along the limb from the anchoring means, as facilitated by the tapered shape of the enclosure. The fastening means then secures the weighted enclosure on the limb in its wrapped position.

In accordance with the method of the invention, the training weight is applied to the limb by the steps of first wrapping the resilient band about a selected region of the limb, such as the wrist or ankle; then wrapping the enclosure in an approximately spiral configuration along the limb in a direction away from the wrapped resilient band. Finally, the fastening means is applied to secure the enclosure from further movement. Preferably, the fastening means is a Velcro band, which is wrapped in a reverse spiral configuration back across the wrapped enclosure, to secure the enclosure in its wrapped position. The resilient band, the tapered enclosure, and the fastening means, all cooperate to provide a training weight that is both securely anchored to the limb and has its weight distributed over an extended portion of the limb.

It will be appreciated from the foregoing that the present invention represents a significant advance in the field of training weights. In particular, the invention provides means for anchoring the weight to prevent movement while being worn and thereby preventing chafing and abrasion of the skin, and a weighted enclosure that is shaped to facilitate the distribution of the weight along the limb. Because of these advantages, the weight is well suited for use in sporting activities. In basketball, for example, weights can be worn during practice to strengthen the arms and to improve shooting and ball handling skills. The weight can be similarly employed to improve skills in other ball games and racket games. Other aspects and advantages of the invention will become apparent from the following more detailed description, taken in conjunction with the accompanying drawings.

DESCRIPTION OF THE PREFERRED EMBODIMENT

Figure 1:
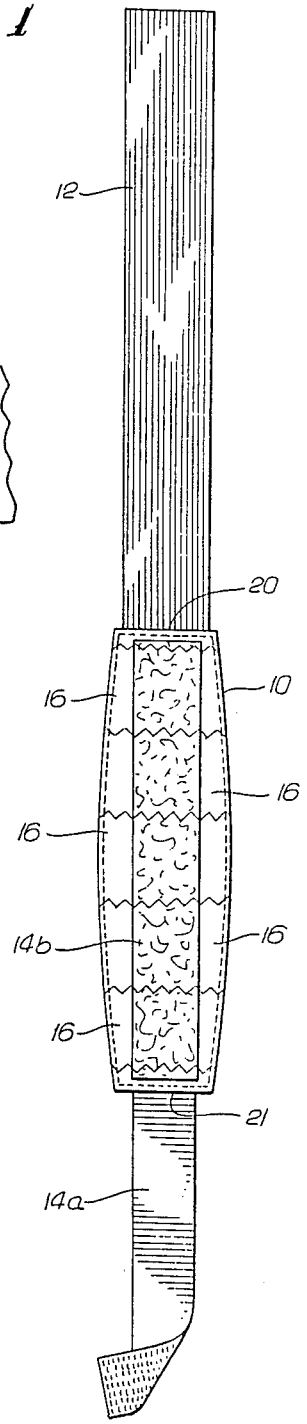
FIG. 1 is a perspective view of a training weight embodying the invention.

As shown in the drawings for purposes of illustration, the present invention is concerned with improvements in the field of training weights. Prior to this invention, training weights for a wrist or ankle consisted of a weighted flat enclosure, typically of plastic or vinyl, and an attached strap, typically using a Velcro or similar type of fastener. Training weights of this general type are difficult to secure to the wrist or ankle, and concentrate the added weight at the point of application.

In accordance with the present invention, a training weight includes a weighted enclosure, indicated by reference numeral 10, that is shaped to facilitate wrapping over an extended region of the limb, a resilient band 12 to anchor the weight to the limb, and a fastener 14*a* and 14*b* to secure the weight in position. More specifically, as shown in FIG. 1, the weighted enclosure 10 is generally flat and rectangular in shape. The sides 18 of the enclosure have their greatest width at their center, tapering toward their ends 20 and 21 to facilitate spiral or helical wrapping of the weighted enclosure. The resilient band 12, which is preferably of an elasticized fabric material, is attached to one end 20 of the weighted enclosure. The fastener 14*a* and 14*b* includes a Velcro strip 14*a* attached to the opposite end 21 of the enclosure, and a complementary strip 14*b* attached to one face of the enclosure. The weighted enclosure 10 is compartmented (as shown at 16) to evenly distribute the weight over its length. The compartments are preferably separated with zig-zag stitching to provide flexibility of the stitching when the enclosure is wrapped.

Figure 2:
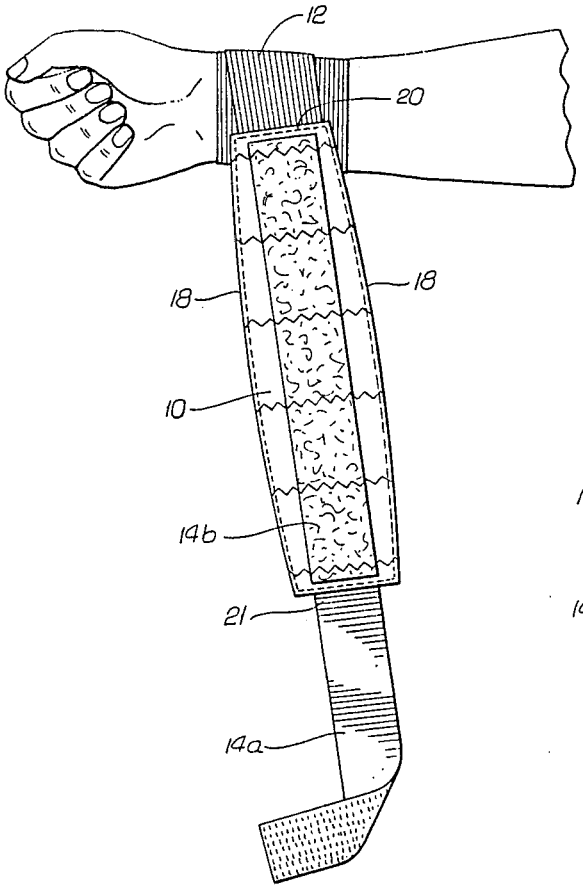
FIG. 2 is a perspective view of the training weight showing the anchoring means wrapped on a wrist.

The training weight is applied with the Velcro strip 14*b* on the weighted enclosure 10 facing away from the limb. With the training weight in this position, the free end of the resilient band 12, which in this embodiment, has a soft nap surface for contact with the skin, is placed against the limb at the desired point of attachment. In the illustrative drawings, the weight is applied to the wrist. The resilient band 12 is wrapped around the wrist a number of times in a fully overlapping manner. This wrapping continues for the full length of the resilient band 12 and can be performed in either direction. FIG. 2 shows the band 12 applied in this manner. The band 12 secures the training weight and inhibits loosening during therapy or sports activities. The resilient nature of the band 12 allows for movement of the wrist while still anchoring the weight securely.

Figure 3:
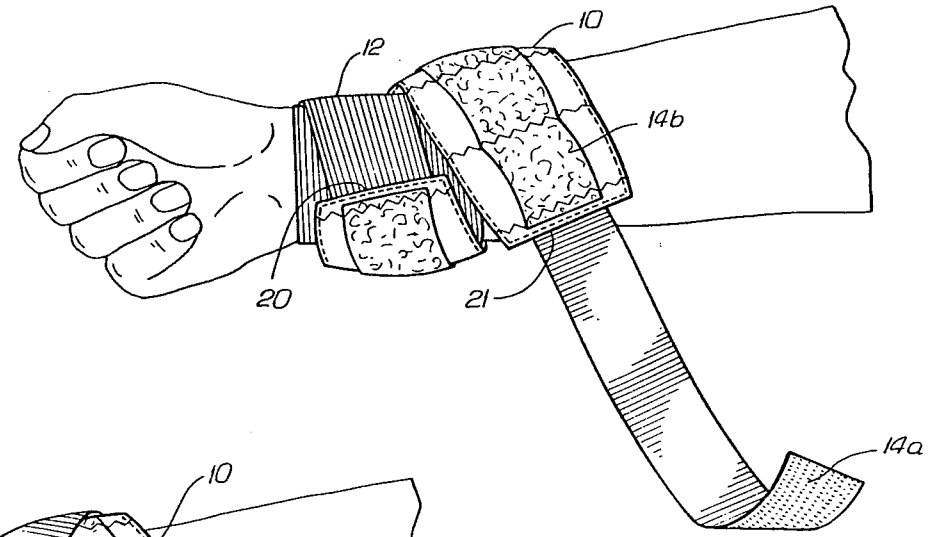
FIG. 3 is a perspective view of the training weight showing the weighted enclosure spirally wrapped on an arm.

After applying the resilient band 12, the weighted enclosure 10 is then wrapped in a helical or spiral configuration on the forearm and along its length, extending in a direction away from the wrapped resilient band 12 as illustrated in FIG. 3. The wrapping continues in the same direction as the resilient band. The sides of the weighted enclosure 10 can be overlapped, touching or spaced apart, depending on the weight distribution desired by the wearer. The weighted enclosure 10 could also be lap wrapped as in the prior art. The tapering of the sides 18 of the weighted enclosure 10 facilitate the various wrapping configuration of the enclosure and prevent gaps along the sides 18 of the enclosure which would cause loosening of the training weight.

Figure 4:
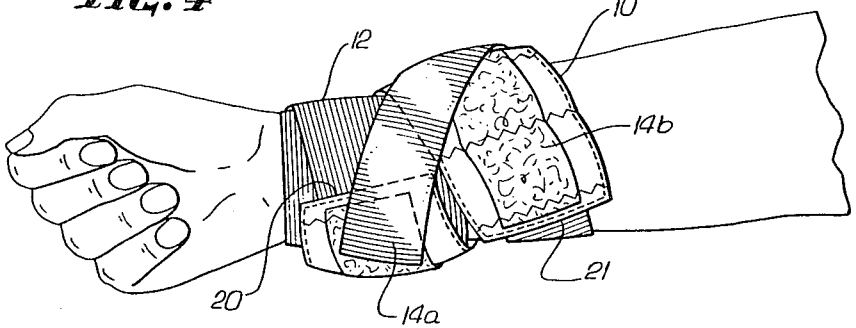
FIG. 4 is a perspective view of the training weight showing it completely secured to an arm.

The Velcro strip 14*a*, which is attached to the end of the weighted enclosure, is finally wrapped in a reverse spiral configuration back across the top of the wrapped enclosure and in contact with the complementary Velcro strip 14*b* attached to the face of the enclosure, thereby securing the training weight to the arm. This is shown in FIG. 4. Only one hand is needed to apply and fasten the weight.

It will be appreciated from the foregoing that the present invention represents a significant advance in the field of training weights. In particular, the invention provides for the distribution of the weight being applied over an extended region of the limb, and provides an extremely secure training weight, thereby preventing chafing, skin abrasion and general discomfort normally associated with the use of training weights. It will also be appreciated that, although a specific embodiment of the invention has been described in detail for purposes of illustration, various modifications may be made without departing from the spirit and scope of the invention. Accordingly, the invention is not to be limited except as by the appended claims.

I claim:

1. A training weight comprising:

a weighted, elongated flexible enclosure, having enclosed weighting material distributed relatively uniformly along its length;

an elastic band attached to only one end of the enclosure for initially wrapping about a limb and inhibiting movement of the training weight; and fastening means secured to the other end of the enclosure;

wherein the enclosure is tapered to a narrower width at its ends, to facilitate wrapping in a spiral configuration about the limb, and the fastening means is releasably attachable to the wrapped enclosure, to secure the training weight in its wrapped configuration, and wherein the fastening means includes a Velcro strip attached to one face of the weighted enclosure and a complementary strip attached to an end of the weighted enclosure.

* * * * *